United States Patent [19]

Sirkis

[11] Patent Number: 4,539,771

[45] Date of Patent: Sep. 10, 1985

[54] HANDGUN OF THE REVOLVER TYPE

[75] Inventor: Nahemia Sirkis, King County, Wash.

[73] Assignee: Detonics Small Arms, Ltd., Bellevue, Wash.

[21] Appl. No.: 441,869

[22] Filed: Nov. 15, 1982

[51] Int. Cl.[3] ..... F41C 1/02

[52] U.S. Cl. ..... 42/64

[58] Field of Search ..... 42/64, 44

[56] References Cited

U.S. PATENT DOCUMENTS

| | | | |
|---|---|---|---|
| 114,653 | 5/1871 | Dodge | 42/64 |
| 227,449 | 5/1880 | Schofield | 42/64 |
| 2,356,709 | 8/1944 | Smith | 42/44 |
| 2,664,786 | 1/1954 | Guisasola | 89/163 |
| 4,316,339 | 2/1982 | Herriott | 42/59 |

FOREIGN PATENT DOCUMENTS

| | | |
|---|---|---|
| 722555 | 3/1932 | France . |
| 751009 | 1/1935 | France . |

OTHER PUBLICATIONS

Hoffschmidt, The Browning Model 1936, pp. 42–43.

*Primary Examiner*—Charles T. Jordan
*Attorney, Agent, or Firm*—Seed and Berry

[57] ABSTRACT

An improved break-top handgun of the revolver type is disclosed which incorporates an improved latching mechanism for securely linking the barrel section and frame together and which compensates for any wear occurring on the engaged surfaces. Also disclosed is an improved linkage connected to the trigger for freeing the ammunition-holding cylinder for rotation and means for retaining the cylinder in engagement with the barrel when the barrel section is separated from the frame for cleaning, loading and/or unloading ammunition.

10 Claims, 10 Drawing Figures

HANDGUN OF THE REVOLVER TYPE

DESCRIPTION

1. Technical Field

This invention relates to a break-top handgun of the revolver type, and more particularly, to improvements in the latch mechanism, means for retaining the ammunitionholding cylinder with the barrel while allowing easy removal, and an improved mechanism for intermittently freeing rotation of the ammunition-holding cylinder.

2. Background Art

Break-top handguns of the revolver type have been known for many years; however, the latch mechanism holding the barrel section to the frame when the gun is in the firing position has presented a problem in compensating for wear due to repeated opening and closing of the barrel section. The latch mechanisms of the prior art also have not had sufficient strength to provide for safe use, particularly when high-powered ammunition is utilized.

DISCLOSURE OF INVENTION

This invention relates to a break-top, hand-held revolver and to improvements in the latch mechanism, means for holding the cylinder in place with the barrel section of the revolver, and improved means for intermittent release of the cylinder for revolution after firing. The latch assembly is pivotally mounted to the frame and includes an upside-down U-shaped latch, with the legs of the "U" pivotally attached to the frame adjacent an upwardly inclined plane which is integral with the rear end of the barrel section. An annular rotatable pin having a flat surface intermediate its ends extends between the legs of the U-shaped latch member, the flat surface contacting the surface of the inclined plane of the barrel section when the barrel section of the gun is locked in place on the frame for firing. The U-shaped latch is biased forwardly and, together with the rotatable pin whose flat surface engages the inclined plane, adjusts for any wear of the inclined plane surface or the pin caused by repeated opening and closing of the barrel section relative to the frame of the weapon.

The gun also includes an improved linkage activated when the trigger is moved rearwardly by the operator of the gun to release the ammunition-holding cylinder for rotation and lock the cylinder in place prior to firing of the gun.

Also disclosed is a caging mechanism for holding the cylinder of the handgun in fixed position relative to the barrel of the gun, yet allowing the cylinder to be easily removed. The cylinder includes a central internal bore extending partway therethrough. The bore is slipped over a shaft extending parallel to and below the barrel of the gun. The rear of the barrel section of the gun extends over the cylinder and includes a downwardly extending lip portion which engages the butt or rear end of the cylinder to prevent it from disengaging from the barrel section when the barrel and frame sections are unlatched.

BEST MODE FOR CARRYING OUT THE INVENTION

Figure 1:
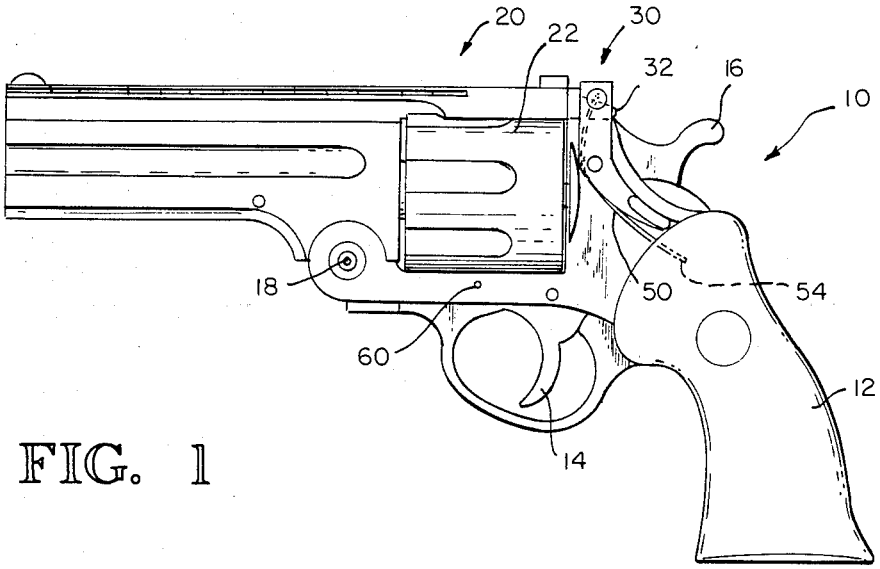
FIG. 1 is a side view of the break-top revolver of this invention.

FIG. 1 depicts a break-top revolver handgun which includes a frame 10 of conventional design, which includes a handle 12, a pivotally mounted trigger 14, and a hammer 16 operated by the trigger to engage a firing pin (not shown), all of conventional design. A barrel section 20, including an ammunition-holding cylinder 22, is secured to a forward extension of the frame 10 by pivot pin 18.

The latch assembly 30 for holding the barrel section 20 in fixed relation to the frame 10 contacts a rearward extension of the barrel section, as will be described. Referring to FIGS. 1 and 3, the barrel section 20 includes an integral rearward extension 32 extending beyond the rear entrance end of the cylinder 22. This rearward extension includes an upwardly inclined surface 34, which cooperates with the latch member shown in FIG. 2 to lock the barrel section to the frame 10 of the revolver for firing.

Figure 2:
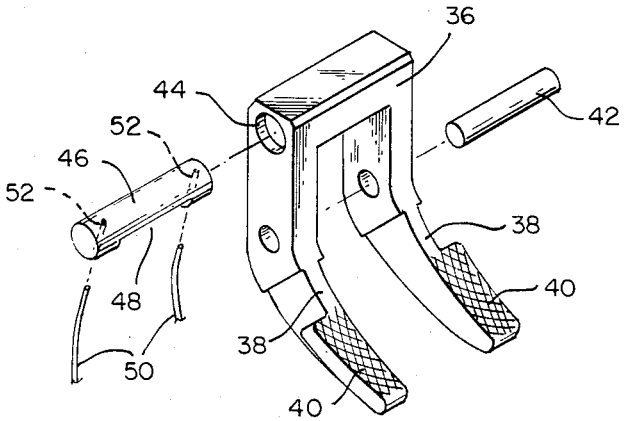
FIG. 2 is a partial perspective view of the latch member of the latch mechanism for holding the barrel section of the revolver firmly in place relative to the frame of the gun when the gun is in condition for firing.
Figure 3:
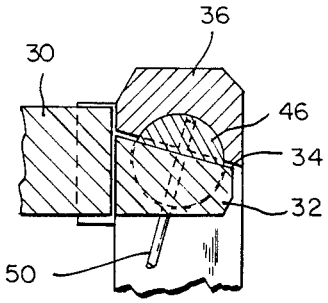
FIG. 3 is a partial vertical cross-section of the latch mechanism of the revolver of FIG. 1 illustrating the manner in which the mechanism compensates for wear occurring during repeated opening and closing of the barrel section relative to the frame section of the gun.

Referring to FIG. 2, the latch member is an upside-down U-shaped member 36 having integral rearward extensions 38 provided with pads 40 of greater width for engagement by the thumb or other finger of the operator of the gun to pivot the latch member rearwardly to allow the barrel section to be broken away from the frame 10 about pivot pin 18. The latch member 36 is pivotally secured to the frame below the rearward extension 32 of the barrel section, as illustrated in FIG. 1, by pivot pin 42. An annular bore 44 extends the width of the latch member 36, as illustrated in FIG. 2, for receiving an annular pin 46 having a flattened surface 48 intermediate the ends of the pin, this annular surface engaging the inclined plane surface 34. The pin 46 is rotatably mounted in bore 44. When the barrel section is latched to the frame 10, the flat surface 48 of the pin engages the inclined surface 34 of the rearward extension of the barrel section 32. The latch member 36 and pin 46 are biased forwardly by two wire springs 50 which terminate at one end in openings 52 drilled in pin 46, as illustrated in FIG. 2. The openings are sufficiently large to allow the pin 46 to rotate within bore 44 a small amount in either direction. The wires 50 extend down the interior sides of each of the legs of the latch member 36, around the pivot pin 42, down the underside of the latch member extensions 38, and are terminated at points 54 in the frame of the gun, as illustrated in FIG. 1.

The forward bias of the latch member 36 and pin 46 against the inclined plane surface 34 of the rearward extension 32 of the barrel section provides a secure, tight lock between the barrel section and the frame at all times and eliminates any play or looseness that may develop due to wear of the inclined surface 34 and the surface 48 of the pin 46 due to repeated opening and closing of the gun. As the surfaces wear, the pin 46 and latch member 36 adjust and compensate for such wear. In addition, the forward bias of the latch member 36 against the inclined plane surface 34 always keeps the barrel section 20 and frame 10 in secure locking arrangement.

Figure 4:
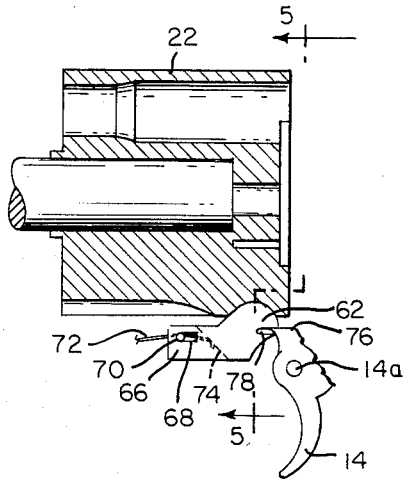
FIG. 4 is a partial vertical cross-section of the ammunition-holding cylinder of the gun of FIG. 1 illustrating the linkage between the trigger and cylinder which, on movement of the trigger rearwardly by the operator of the gun, frees the cylinder for rotation.
Figure 5:
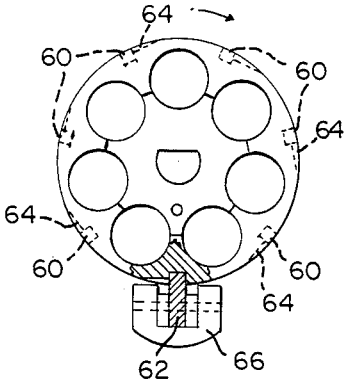
FIG. 5 is an end view along section line 5—5 of FIG. 4.
Figure 6:
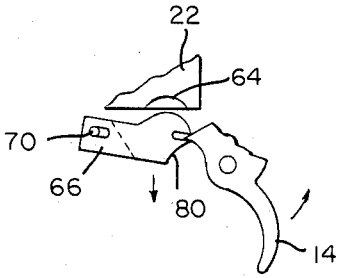
FIGS. 6–9 illustrate movement of the linkage as the trigger is moved rearwardly to fire the gun.
Figure 7:
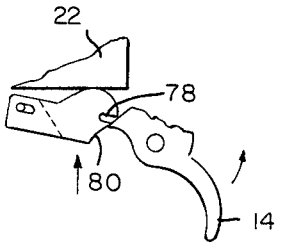
Figure 8:
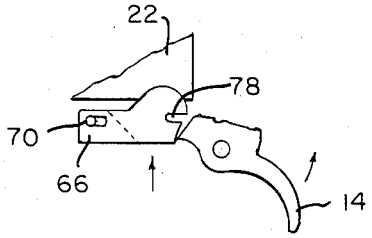
Figure 9:
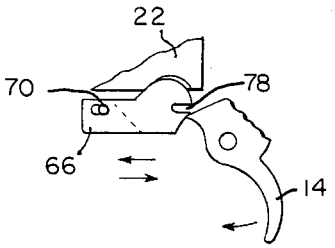

FIGS. 4–9 illustrate an improved linkage activated by the trigger 14 of the gun to allow the cylinder 22 to revolve to the next adjacent opening holding ammunition prior to firing of the round of ammunition in the cylinder. Referring to FIG. 5, the cylinder includes a series of spaced notches 60 adapted to receive detent 62 of the linkage. One sidewall 64 of each of the notches is dished out to allow the detent to slide into the notch as the cylinder is rotate in the direction of the arrow shown in FIG. 5. The detent is an integral part of the linkage which includes a forward body portion 66 containing an elongated slot 68 (see FIG. 4). The linkage is mounted to both pivot about pivot pin 70 as well as slide horizontally in slot 68. The pivot pin 70 is dead-ended to the frame of the gun. A spring 72 has one end biased against surface 74 of the linkage, is wrapped about the pivot pin 70, and is dead-ended in the frame of the gun. The detent 62 is biased upwardly through an opening in the frame beneath the cylinder 22. The trigger 14 is mounted to pivot about pivot point 14*a* and includes a finger 76 which engages a slot 78 of the detent, as illustrated in FIG. 4. As the trigger is moved rearwardly about its pivot point 14*a*, it pulls the linkage and detent 62 downwardly, as illustrated in FIG. 6, to free the cylinder 22 for rotation. As the trigger is moved further rearwardly, as illustrated in FIG. 7, the terminal edge of the finger slips out of the slot 78 and engages surface 80 of the detent, as illustrated in FIG. 7, to exert an upward and forward force on the linkage. As the cylinder revolves, the detent 62 lodges in the next adjacent notch 60, as illustrated in FIG. 8. As the trigger is further moved rearwardly, the gun fires. Then, when the trigger is released and is moved forwardly, as illustrated in FIG. 9, the linkage 66 and detent 62 are moved horizontally in the direction of the upper arrow of FIG. 9 until the terminal edge of the finger 76 again engages the slot 78, whereupon the spring 74 urges the linkage 66 rearward to the position illustrated in FIG. 4.

Figure 10:
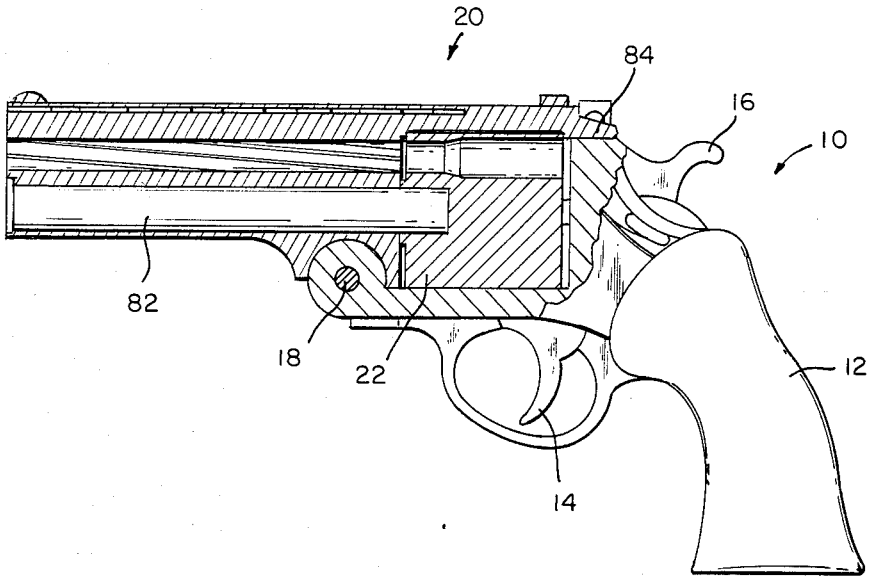
FIG. 10 is a partial vertical cross-sectional view of the gun of FIG. 1 illustrating the manner in which the ammunition-holding cylinder is caged in place to the barrel section, yet allowing easy removal.

FIG. 10 illustrates a further improvement of the revolver-type handgun in caging or trapping the cylinder 22 so that it will remain with the barrel section 10 when the barrel section is pivoted away from the frame 10 about pivot pin 18 on release of the latch. Referring to FIG. 10, the cylinder 22 includes a bore opening in the forward end thereof which receives the terminal end of the shaft 82. The cylinder 22 is rotatably mounted on the rear end of the shaft 82 for free rotation; however, the cylinder would disengage from the shaft without something to hold it in place. In this regard, the upper portion of the barrel section 10 includes a downwardly extending lip 84 which engages the rear peripheral edge of the cylinder 22, preventing it from disengaging from the shaft on breaking away of the barrel section from the frame of the gun to pivot about pivot 18 for cleaning, loading or unloading ammunition. The cylinder 22 is easily removable, however, by removing shaft 82, thus allowing the cylinder 22 to be easily removed.

These improvements to a break-top handgun of the revolver type provide the gun with greater accuracy, greater safety, and smoother operation.

I claim:

1. A latch mechanism for a break-top handgun of the revolver type, comprising:

a frame including an integral handle, hammer, firing pin, and trigger operatively attached to the hammer;

a barrel section including a rotatable ammunition-holding cylinder pivotally attached to the frame for movement between a first position for firing of the gun and a second position exposing the rear end of the cylinder for loading ammunition, unloading ammunition and cleaning of the cylinder or gun barrel;

an upwardly inclined planar surface extending rearwardly from the entrance end of the barrel section;

a latch assembly pivotally mounted to the frame for movement between a first position holding the frame and barrel section in fixed position relative to one another when the gun is to be fired and a second position where the barrel is broken away from the frame, the latch assembly including a pivotable latch member having a separately rotatable planar surface positioned for engaging the upwardly inclined planar surface on the barrel section when in the first position to prevent separation of the barrel section from the frame during firing and to compensate for wear of the upwardly inclined planar surface or the latch assembly caused by repeated opening and closing of the barrel section relative to the frame of the gun; and means biasing the latch member forwardly to engage the separately rotatable planar surface against the upwardly inclined planar surface.

2. The latch mechanism of claim 1 wherein the latch member is an upside-down U-shaped latch member whose respective legs are pivotally attached to each side of the frame and wherein the base of the "U" of the latch member includes the separately rotatable planar surface for engaging the upwardly inclined planar surface on the barrel section.

3. The latch mechanism of claim 1 wherein the latch member includes a support member pivotally attached to the frame and wherein the rotatable planar surface includes a member separately rotatable relative to the pivotable support member and having a planar surface portion adapted to engage the inclined planar surface of the barrel section.

4. The latch mechanism of claim 3 wherein the means biasing the latch member against the inclined planar surface includes a spring biasing the the rotatable planar surface of the rotatably member against the upwardly inclined planar surface on the barrel section.

5. A latch mechanism for a break-top handgun of the revolver type, comprising:

a frame including an integral handle, hammer, firing pin, and trigger operatively attached to the hammer;

a barrel section including a rotatable ammunition-holding cylinder pivotally attached to the frame for movement between a first position for firing of the gun and a second position exposing the rear end of the cylinder for loading ammunition, unloading ammunition and cleaning of the cylinder or gun barrel;

an upwardly inclined planar surface extending rearwardly from the entrance end of the barrel section;

a latch assembly pivotally mounted to the frame for movement between a first position holding the frame and barrel section in fixed position relative to one another when the gun is to be fired and a second position where the barrel is broken away from the frame, the latch assembly including an upside-down U-shaped latch member whose respective legs are pivotably attached to each side of the frame, the base of the "U" of the latch member having a rotatable planar surface for engaging the upwardly inclined planar surface on the barrel section in the first position to prevent separation of the barrel section from the frame during firing and to compensate for wear of the latch assembly caused by repeated opening and closing of the barrel section relative to the frame of the gun, the rotatable planar surface including a rotatable pin having a planar surface adapted to engage the inclined planar surface on the barrel section; and means biasing the latch member forwardly against the upwardly inclined planar surface engaged by the latch member.

6. The latch mechanism of claim 5 wherein the means biasing the latch member against the inclined planar surface includes a spring biasing the planar surface of the pin and the latch member against the upwardly inclined planar surface on the barrel section.

7. A latch mechanism for a break-top handgun of the revolver type, comprising:

a frame including an integral handle, hammer, firing pin, and trigger operatively attached to the hammer;

a barrel section including a rotatable ammunition-holding cylinder pivotally attached to the frame for movement between a first position for firing of the gun and a second position exposing the rear end of the cylinder for loading ammunition, unloading ammunition and cleaning of the cylinder or gun barrel;

an upwardly inclined planar surface extending rearwardly from the entrance end of the barrel section;

a latch assembly pivotally mounted to the frame for movement between a first position holding the frame and barrel section in fixed position relative to one another when the gun is to be fired and a second position where the barrel is broken away from the frame, the latch assembly including a support member pivotably attached to the frame and an engagement member rotatably supported by the support member, the engagement member having a planar surface for engaging the upwardly inclined planar surface on the barrel section when the latch assembly is moved into the first position to prevent separation of the barrel section from the frame during firing, the engagement member planar surface being separately rotatable relative to the pivotable support member to compensate for wear of the upwardly inclined planar surface or the latch assembly caused by repeated opening and closing of the barrel section relative to the frame of the gun; and means biasing the latch assembly forwardly to engage the engagement member planar surface against the upwardly inclined planar surface.

8. The latch mechanism of claim 7 wherein the support member has an upside-down U-shape with the respective legs of the support member pivotally attached to each side of the frame and with the base of the "U" of the support member rotatably supporting the engagement member and positioning the separately rotatable planar surface for engaging the upwardly inclined planar surface on the barrel section.

9. The latch mechanism of claim 8 wherein the engagement member is a pin rotatably disposed in a bore extending through the U-shaped support member and the engagement member planar surface is positioned on the pin between the legs of the support member.

10. The latch mechanism of claim 9 wherein the means biasing the latch assembly forwardly includes a spring biasing the planar surface of the pin against the upwardly inclined planar surface on the barrel section.

* * * * *